US006120240A

United States Patent [19]

Ghilardi

[11] Patent Number: 6,120,240

[45] Date of Patent: Sep. 19, 2000

[54] METHOD AND DEVICE FOR SEPARATING GROUPS OF FLAT PRODUCTS FROM EACH OTHER, AND A FOLDING MACHINE COMPRISING SAID DEVICE

[75] Inventor: Mauro Ghilardi, Lucca, Italy

[73] Assignee: Fabio Perini S.p.A., Lucca, Italy

[21] Appl. No.: 09/117,265

[22] PCT Filed: Jan. 24, 1997

[86] PCT No.: PCT/IT97/00016

§ 371 Date: Jul. 27, 1998

§ 102(e) Date: Jul. 27, 1998

[87] PCT Pub. No.: WO97/28076

PCT Pub. Date: Aug. 7, 1997

[30] Foreign Application Priority Data

Jan. 30, 1996 [IT] Italy ..... FI96A0008

[51] Int. Cl.[7] ..... B65H 33/18

[52] U.S. Cl. ..... 414/798.9; 198/419.3; 414/790.2

[58] Field of Search ..... 414/790.2, 789.9, 414/798.9; 198/461.1, 419.3

[56] References Cited

U.S. PATENT DOCUMENTS

| | | | |
|---|---|---|---|
| 3,190,434 | 6/1965 | Dardaine | 198/419.3 |
| 3,451,521 | 6/1969 | Fehst et al. . | |
| 3,662,875 | 5/1972 | Salomon | 198/419.3 |
| 4,098,392 | 7/1978 | Greene | 198/419.3 |
| 4,625,957 | 12/1986 | DuFresne | 198/419.3 |
| 4,938,465 | 7/1990 | Marsiletti . | |
| 5,201,823 | 4/1993 | Pazdernik | 198/419.3 |
| 5,281,082 | 1/1994 | Ghilardi . | |
| 5,393,196 | 2/1995 | Bluemle | 414/790.2 |

FOREIGN PATENT DOCUMENTS

| | | |
|---|---|---|
| 2 398 007 | 2/1979 | France . |
| 24 27 635 | 12/1975 | Germany . |
| 55-7165A | 1/1980 | Japan . |

*Primary Examiner*—Gregory Morse
*Attorney, Agent, or Firm*—Breiner & Breiner

[57] ABSTRACT

A device for separating from each other packs or groups of flat articles including a channel for the advance of the articles and, associated with the channel, a plurality of separating fingers which are movable along a closed path is described. On each side of the advance channel at least one pair of guides, placed one above the other and having substantially equal extensions, is provided to form the closed path. Pairs of sliders are disposed along the guides, and each slider carries at least one corresponding separating finger. A phase displacement means, which temporarily moves the first slider away from the second slider of each pair to move one pack of articles away from a following pack, is disposed at the end of the forward portion.

31 Claims, 8 Drawing Sheets f33
33A
33B
33
P2
P1
M1
M2
f35
35
19
9
19A
15
31A
31
f31
P
11
7
5
3
3A
B
1
1A
A
N
VI

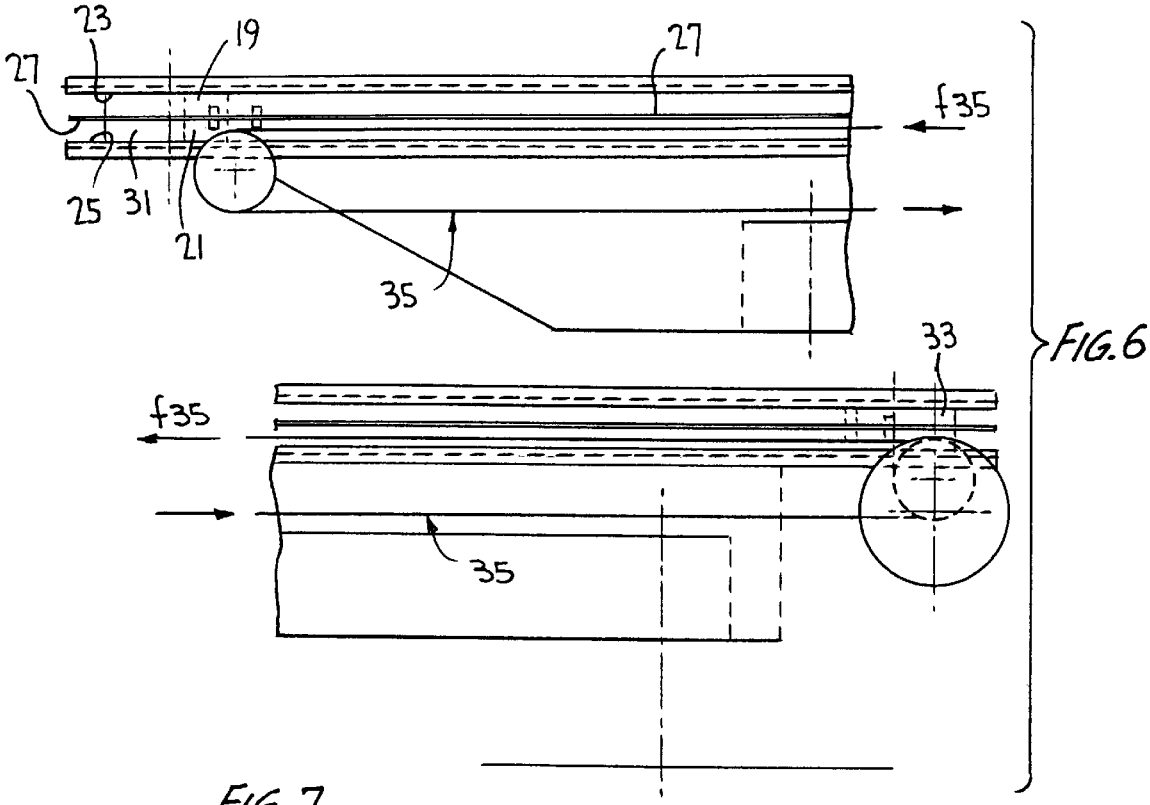
FIG. 6
FIG. 7
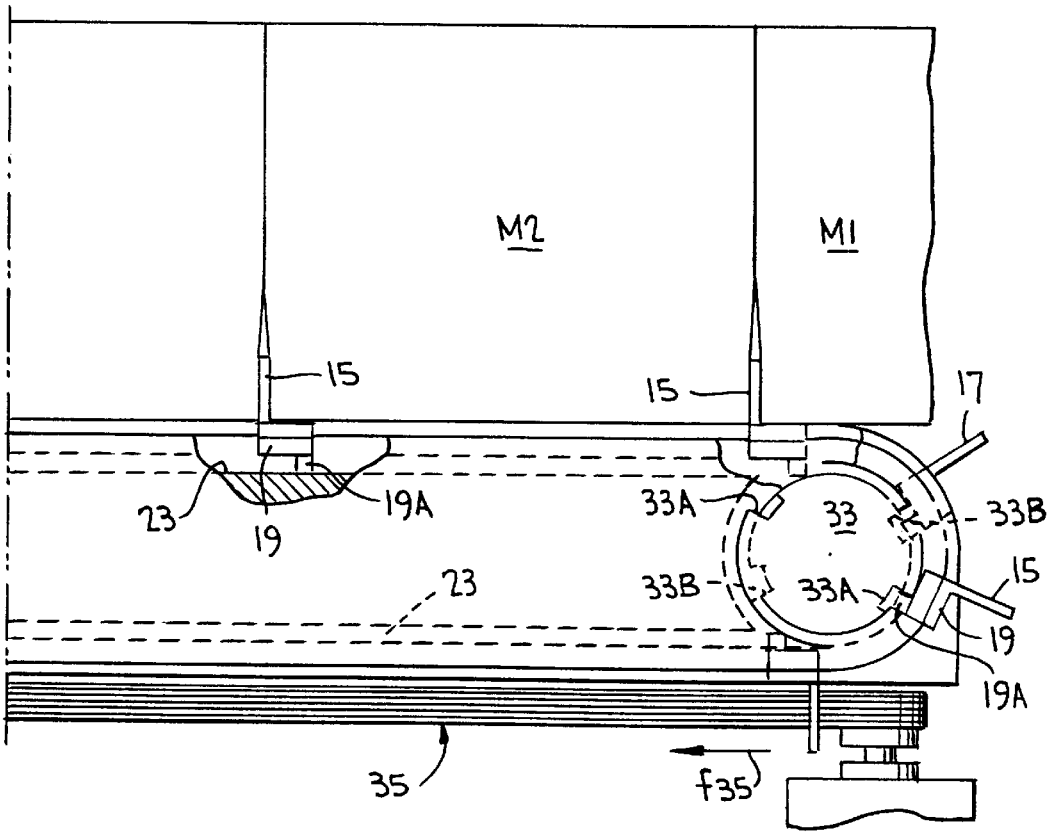

METHOD AND DEVICE FOR SEPARATING GROUPS OF FLAT PRODUCTS FROM EACH OTHER, AND A FOLDING MACHINE COMPRISING SAID DEVICE

TECHNICAL FIELD

The present invention relates to a device and to a corresponding method for separating packs or groups of flat products, each containing a predetermined number of articles and being continuously fed to be sent, for example, to a packaging machine.

Devices of this type are frequently combined with machines for forming paper napkins and similar products. They normally have a channel for the advance of the articles and, associated with said channel, a plurality of separating fingers which are movable along a closed path comprising a forward portion, which is parallel to the channel for the advance of the articles and in which the separating fingers advance parallel to and simultaneously with the articles, and a return portion.

BACKGROUND ART

Paper napkins are formed with forming machines comprising a pair of folding rollers with vertical axes forming a throat through which is fed a paper strip material which is normally folded along a longitudinal line. A system of clamps or suction holes associated with the folding rollers grips the strip material alternately on one side and on the other, so that it is folded in a zigzag configuration after the throat of the rollers. In this way a horizontal stack of folded strip material is formed, and this is pressed against a central blade which cuts the stack into two symmetrical parts, creating two parallel stacks of napkins. The two stacks have to be divided into packs or groups, each containing a predetermined number of napkins. Various separating devices have been designed for this purpose.

In one type of folder, the separation between consecutive packs of napkins is carried out by disposing the napkins in a saw-tooth configuration and inserting separating fingers-between adjacent packs to achieve their separation and discharge. Examples of machines of this type are described in U.S. Pat. No. 3,451,521, DE-A-2,427,635 and U.S. Pat. No. 5,281,082.

In other types of machine, the napkins leave the machine, forming a uniform stack. The two folding rollers of the forming machine are associated with two continuous conveyors disposed on both sides of the channel for the to advance of the stack of material leaving the folder, these conveyors carrying a plurality of separating fingers which are inserted between successive packs of napkins. Each pair of fingers is disposed in a waiting position behind the folding rollers or in a recessed housing in one of the rollers, and when the desired number of napkins has been reached the separating fingers are made to advance with the folded product to the discharge area. A device of this type is described in JP-A-55 7165 A separator which is similar, but which is combined with a machine which feeds previously cut flat sheets, is described in FR-A-2 398 007. In this device, the separating fingers are temporarily released from the continuous conveyor, represented by a chain, and remain housed in a recessed housing of the roller feeding the flat articles. When the desired number of flat articles has been reached, the fingers are engaged with the conveyor and begin to advance in the same direction as the stack of sheets leaving the machine.

A similar system is described in U.S. Pat. No. 4,938,465. Here the separating fingers are engaged with or disengaged from the continuous conveyor by means of a complex magnetic system. In the napkin discharge area, the separating fingers guide a pick-up jaw which grips the individual packs of napkins from above and removes them.

The systems known at the present time are complex and expensive.

DISCLOSURE OF INVENTION

The object of the present invention is to provide a separating device for the separation of packs of flat articles taken from a stack of continuously fed articles, which is simpler and more reliable than the conventional devices.

Another object of the present invention is to provide a device which is more economical than the known devices.

A further object of the present invention is to provide a machine for forming napkins or similar products, which has an efficient and fast separating device.

The object of the present invention is also to provide a device which is particularly flexible, in other words one which is capable of permitting the forming of packs containing any number of articles, without the necessity of complex adaptation operations, and which has a limited number of moving parts and actuators.

These and further objects and advantages, which will be evident to those skilled in the art from the reading of the following text, are obtained with a device of the type mentioned above, comprising at least one pair of guides, placed one above the other and having substantially equal extensions, forming the closed path, pairs of sliders being disposed along said guides, a first slider of each said pair being disposed in a first of said guides and a second slider being disposed in a second of said guides and each slider carrying at least one corresponding separating finger. A phase displacement means, which temporarily moves said first slider away from said second slider of each pair to move one pack of articles away from the following pack, is disposed at the end of the forward portion of the closed path of the separating fingers. During the phase in which the two sliders are moved away from each other, one of them is preferably kept stationary, to retain the articles, while the other is made to advance.

With this disposition it is simple to move one pack of articles to be discharged away from the preceding pack. Since the two separating fingers of each pair are independent of each other, the movement of the fingers away from each other may be relatively large, and such as to permit the guidance of the pack to be discharged in its tipping movement and to facilitate the insertion of a temporary retaining member, for example a blade, between the pack being discharged and the following pack which is still disposed in the stack of articles advancing along the channel.

One or two pairs of guides in which one guide is above the other may be provided, according to the type of articles to be handled and the shape of the advance channel. In the case in which the separating fingers penetrate, for example, into the stack of articles from below (in a similar way to that specified in FR-A-2 398 007), it is sufficient to dispose a pair of guides, placed one above the other or beside each other, under the advance channel, which has suitable slots in its base for the passage of the separating fingers. Conversely, if the separating fingers penetrate into the stack of articles from the sides, they will be disposed preferably on both sides of the stack. In this case, the device will comprise two pairs of guides in which one guide is above the other, positioned along both sides of the channel for the advance of the articles.

In a possible embodiment of the device, the phase displacement means comprises a slotted sprocket rotating about its own axis, provided with two sets of first engagement means (for example, two sets of slots) disposed at different heights along the axial extension of said sprocket and angularly displaced from each other. Said first engagement means interact with second engagement means (appendages, for example) associated with said sliders. This configuration is particularly simple and reliable. However, different solutions, for example a pair of oscillating arms driven by a linear actuator or similar, are not excluded.

Advantageously, in order to simplify the structure of the device, it is possible to make the sliders freely slidable in the corresponding guides along the forward portion of the closed path, and to have them propelled by the articles among which they are inserted. This provides, considerable advantages over the conventional machines described, for example, in the prior patents cited above. In particular, all the complex systems for propelling the fingers and for engaging and disengaging the sliders with and from the propelling systems are dispensed with. The device thus becomes much simpler and more reliable.

In the return path, the sliders may be accumulated and pushed by the same phase displacement means which takes individual pairs of sliders from the forward path and transfers them to the return path. Conversely, a return actuating means associated with said return portion of said closed path may be provided, to return the sliders to the start of the forward portion of the path. The actuating means may consist of a cylinder and piston pushing system, a pneumatic system or, preferably, a flexible member of the belt or equivalent type, which engages with the sliders to propel them in a direction opposite to the direction of advance of the articles in the device. For this purpose it is possible to provide bristles interacting with the separating fingers associated with one of said guides, while the separating fingers associated with the other guide may be coupled (as a result of special shaping) to the fingers engaged by the bristles of the flexible member or other actuating means. This solution is particularly simple and reliable, and eliminates any type of reciprocating movement as well as the consumption of compressed air.

The device may have an inserting member which takes individual pairs of sliders from the return portion of said closed path and inserts them into the forward portion, between one pack of formed articles and the following pack. The inserting member may cause the separating fingers to follow a suitable trajectory, which may also interfere with the corresponding folding roller of the folding machine with which the device is associated. In this case, the folding roller will be provided, in a known way, with a suitable annular groove.

The inserting member may consist of a slotted disc rotating step by step about its own axis and provided with engagement elements which interact with corresponding engagement means associated with the sliders disposed in the two guides placed one above the other.

Various systems may be provided at the discharge end of the device for the discharge of the packs of articles separated by the separating fingers. In a particularly advantageous embodiment, a tipping surface may be provided at the end of said channel for the advance of the articles, with a conveyor to remove the articles. The tipping surface comprises a stop for the articles, and is movable parallel to the direction of advance of the articles. The movement may be obtained in a passive way, by the insertion of an elastic member, for example a coil spring, or may be obtained by means of a suitable actuator controlled in a suitable way by the central unit of the device.

Further advantageous characteristics and embodiments of the device according to the invention will be described in the following text.

The invention also relates to a folding machine for producing paper napkins or similar products, and to a method for separating packs of flat articles, for example folded paper napkins, as specified in the attached claims.

BRIEF DESCRIPTION OF THE DRAWINGS

The invention will be more clearly understood from the description and the attached drawing, which shows a practical and non-restrictive example of the invention. In the drawing.

FIG. 6 shows a side view through VI—VI in FIG. 1;

FIGS. 7 to 9 show an enlarged detail of the view in FIG. 1, in three successive phases of the cycle of discharge of a pack or group of articles;

DETAILED DESCRIPTION OF AN EMBODIMENT OF THE INVENTION

Figure 1:
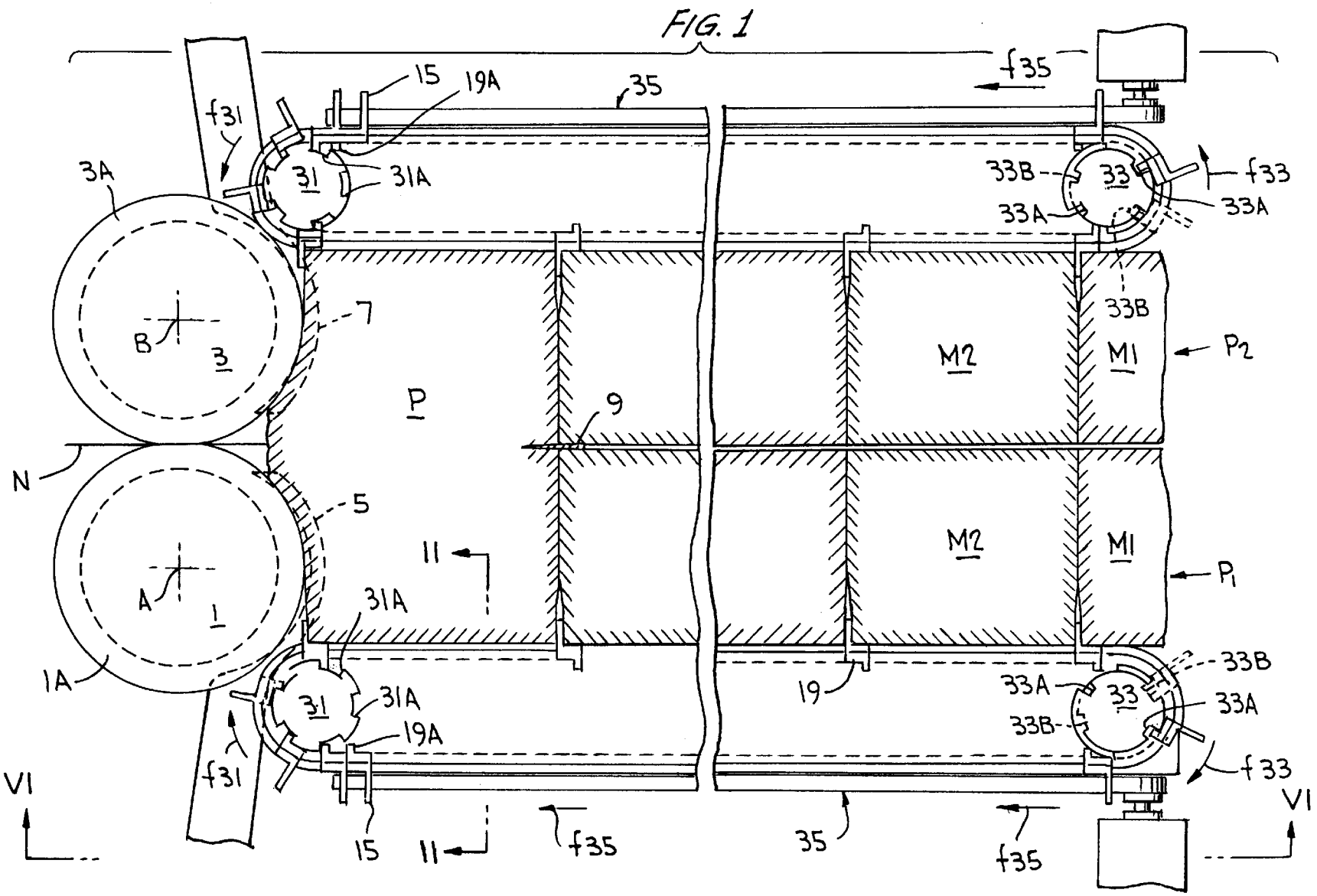
FIG. 1 is a plan view of the device according to the invention fitted to a folding machine for the production of napkins.

In the attached drawing, the numbers 1 and 3 indicate two folding rollers of a folding machine for the formation of a stack P of napkins. The folding rollers 1 and 3, which rotate about two vertical axes A and B, have annular grooves 1A, 3A which house curved arms 5 and 7 which detach the folded material from the roller and push it against the stack P of previously formed articles leaving the machine. A continuous strip material N, which may be folded along a longitudinal line, is fed into the throat formed between the two rollers, these rollers being associated systems of a known type which fold the material leaving the throat once around the roller 1 and once around the roller 3 to produce a stack of material folded in a zigzag configuration. With each fold, the corresponding curved arm 5, 7 detaches the material from the roller and pushes it towards the previously formed stack P.

The operation of the folding machine described in summary form is known and therefore will not be illustrated in greater detail.

The stack P of folded strip material is pushed against a transverse blade 9 which cuts the stack into two parts P1 and P2, each formed by a plurality of napkins folded in four. After the blade 9 there is disposed a divider which keeps the two parts P1, P2 into which the stack has been cut separate from each other, permitting independent handling of these two parts. The stack P, P1, P2 advances in an advance channel formed by a pair of side pieces 11 and a base panel 12, at the end of which packs of napkins M1, M2 . . . Mn, each containing a predetermined number of articles, are discharged.

To separate one pack of napkins M1 from the following pack M2, pairs of separating fingers 15, 17 are disposed at the sides of the channel for the advance of the stack P, P1, P2. Each separating finger 15, 17 is integral with a corresponding slider 19, 21 which slides in a corresponding guide 23, 25. Two guides 23, 25, one placed above the other, and separated by a dividing wall 27 made of material with a low coefficient of friction, to facilitate the sliding of the sliders, are disposed on each side of the channel for the advance of the stack P, P1, P2. The guides 23, 25 form a closed path and in each of them is disposed an identical number of sliders 19 and 21 respectively, in such a way that on each side of the advance channel each slider 19 and the corresponding finger 15 in the guide 23 is matched by a slider 21 and a corresponding finger 17 in the lower guide 25. An identical number of pairs of fingers 15, 17 is disposed on each side of the channel.

On each side of the channel for the advance of the stack P, P1, P2, each of the two guides 23, 25 has two rectilinear sections parallel to the direction of advance of the stack P, connected by circular end portions, one adjacent to the corresponding folding roller 1, 3 and the other at the napkin discharge area.

As shown in FIGS. 2 to 5, the sliders 19, 21 and the corresponding fingers 15, 17 are shaped in such a way that, when two sliders 19, 21 are positioned with one above the other, the upper slider 19 engages with the lower slider 21, in such a way that when said lower slider is propelled in the clockwise direction along the corresponding guide 25 it propels with it the upper slider 19, for purposes which will be explained subsequently. This is achieved by means of the stepped shape of the two facing edges of the separating teeth 15, 17, shown in detail in the front view in FIG. 3.

At the curved areas of the guides 23, 25 there is a slotted disc 31 (near the corresponding folding roller 1, 3) and a slotted sprocket 33 (in the discharge area). The slotted disc 31 has a set of longitudinal slots 31A whose depth is approximately equal to the thicknesses the two guides 23, 25. Each slot 31A engages with two sliders 19, 21, located one above the other, by means of appendages 19A, 21A provided on the rear part (in other words the part opposite the separating fingers 15, 17) of each slider. With this disposition, the step-by-step rotation in a clockwise direction (arrow f31) of the slotted disc 31 causes the sliders 19, 21 to be transferred in pairs from the corresponding outer rectilinear section of the guide 23, 25 to the inner rectilinear section, in other words that facing the stack P of articles, while the relative position of the sliders 19, 21 one above the other is maintained. The step-by-step rotation of the slotted disc 31 may be produced by any suitable system, for example by a free-wheel mechanism driven by a linear cylinder and piston actuator, or by a rotary actuator.

Conversely, the slotted sprocket 33 has two sets of slots 33A, 33B, angularly displaced from each other by approximately 30–40° and disposed on two different levels along the longitudinal extension of the sprocket. In this way, since the appendages 19A and 21A of the sliders 19 and 21 are disposed at different heights, the step-by-step rotation in the clockwise direction (arrow f33) of the slotted sprocket 33 causes the sliders 19, 21 to be transferred from the inner rectilinear section to the outer rectilinear section of the corresponding guides, and simultaneously causes an angular displacement of each slider 19 and of the corresponding finger 15 with respect to the lower slider 21 and the corresponding finger 17. The displacement is equal to approximately 30–40°, in other words equal to the angular displacement of the slots 33A, 33B. This causes a significant movement of the ends of the fingers 15, 17 away from each other.

Figure 1A:
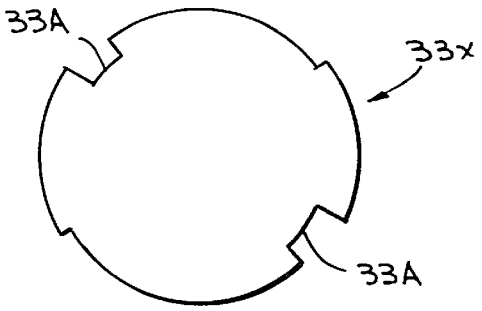
FIGS. 1A and 1B show the two parts in which the toothed sprocket for the phase displacement of the sliders carrying the separating fingers may be made.
Figure 1B:
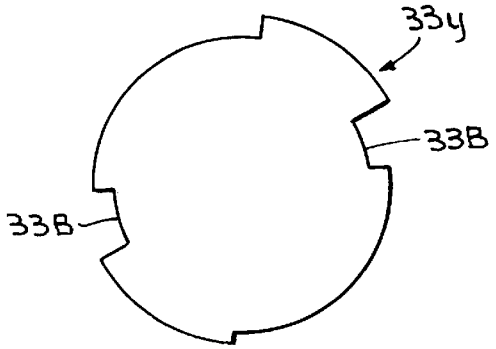
Figure 5:
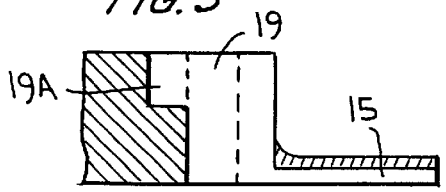
FIGS. 4 and 5 show local sections through the lines IV—IV and V—V in FIGS. 2 and 3.
Figure 2:
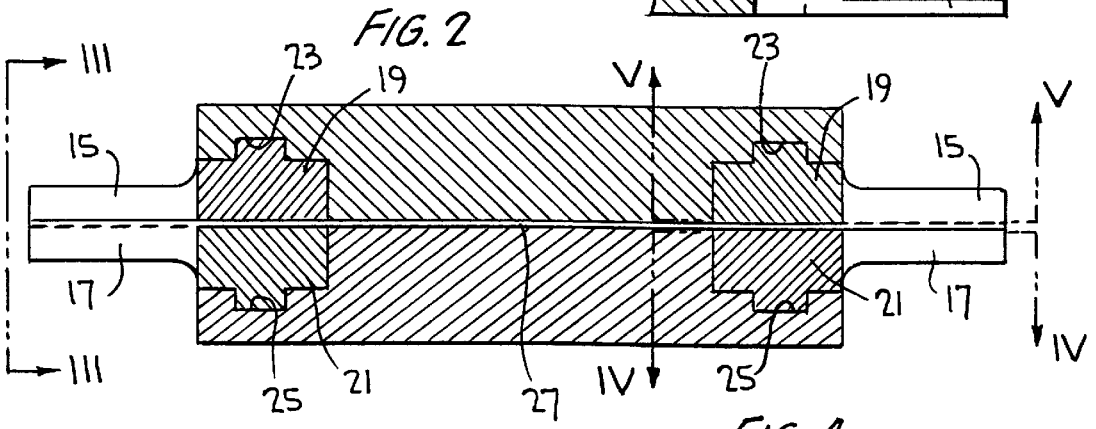
FIG. 2 shows a local transverse section through II—II in FIG. 1.
Figure 4:
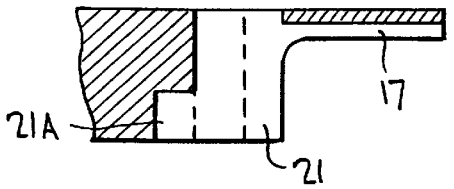
Figure 3:
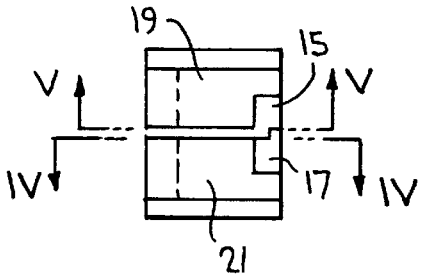
FIG. 3 shows a local front view through III—III in FIG. 2.

In practice, the slotted sprocket 33 may be made in two discoid parts which are connected to each other. FIGS. 1A, 1B show separately the two discoid parts 33X, 33Y in the angular position with respect to each other in which they may be fitted. The two slots 33A are made in the discoid part 33X, while the two slots 33B are made in the discoid part 33Y. This configuration facilitates and simplifies the making of the sprocket 33. Slotted sprockets 33 with different displacements between the slots 33A, 33B may also be made in this way (from identical elements). If the two parts 33X, 33Y are connected reversibly, the same slotted sprocket 33 may be adjusted according to specific production requirements, providing a variable and adjustable displacement between the slots 33A and 33B.

On each side of the channel for the advance of the stack P, P1, P2 of articles, and parallel to the outer rectilinear section of each pair of guides 23, 25, there extends a continuous flexible member 35 running around two pulleys and provided with bristles which engage with the fingers 17 transferred from the slotted sprocket 33 to the outer rectilinear section of the corresponding guide 25 and propel them as shown by the arrow f35 in the opposite direction to the direction of advance of the stack P, P1, P2 of articles. As described above, the shape of the sliders 19, 21 and of the fingers 15, 17 is such that the advance of the finger 17 and of the slider 21 by the bristles of the continuous flexible member 35 causes the propulsion of the corresponding upper slider 19. The sliders 19, 21 are carried by the flexible member 35 until they are stopped by the slotted disc 31, as shown in FIG. 1. Several pairs of fingers 15, 17 are accumulated behind the slotted disc 31, while the flexible member 35 can run under them, owing to the deformation of the bristles with which this member is provided. With each rotation of the slotted disc 31, the fingers 15, 17 accumulated against it are pushed to maintain the contact with the disc. The number of waiting fingers 15, 17 behind the slotted disc 31 depends on the size of the packs of articles M1–Mn being formed; the number of stationary pairs of fingers 15, 17 increases with the size of each individual pack.

The device described up to this point operates as follows.

The folding rollers 1 and 3 rotate continuously, forming the stack P, which is then cut by the blade 9 into the two parts P1, P2. In this phase, a pair of separating fingers 15, 17 is waiting next to each roller 1 and 3, and remains stationary outside the folding area. When a predetermined number of folds has been reached, producing a predetermined number of napkins by means of the cut made by the blade 9, on each side of the machine the corresponding slotted disc 31 rotates by one step, bringing the pair of sliders 19, 21, and therefore the corresponding fingers located one above the other 15, 17, from the withdrawn position outside the folding rollers towards the folding area, in a position more advanced than the point at which the following fold of the strip material N is made. This movement is made possible by the presence of annular grooves in the folding rollers 1 and 3. The sliders 19 and 21 are fully released from the slotted disc 31 and become free to slide in the guides 23 and 25 respectively along the section of the path facing the advance channel.

When the feed of the strip material N, and consequently the folding of the material with the accumulation of the folded material in the stack P, is continued, the two pairs of fingers 15, 17 on the two sides of the advance channel, propelled by the corresponding slotted discs 31 into the active folding area, remain engaged between one fold and the next, and start to advance along the guides 23, 25 pushed by said stack P, P1, P2 of articles advancing as a result of the action of the arms 7. No positive means of advancing the separating fingers along the active section of their path is required.

Figure 8:
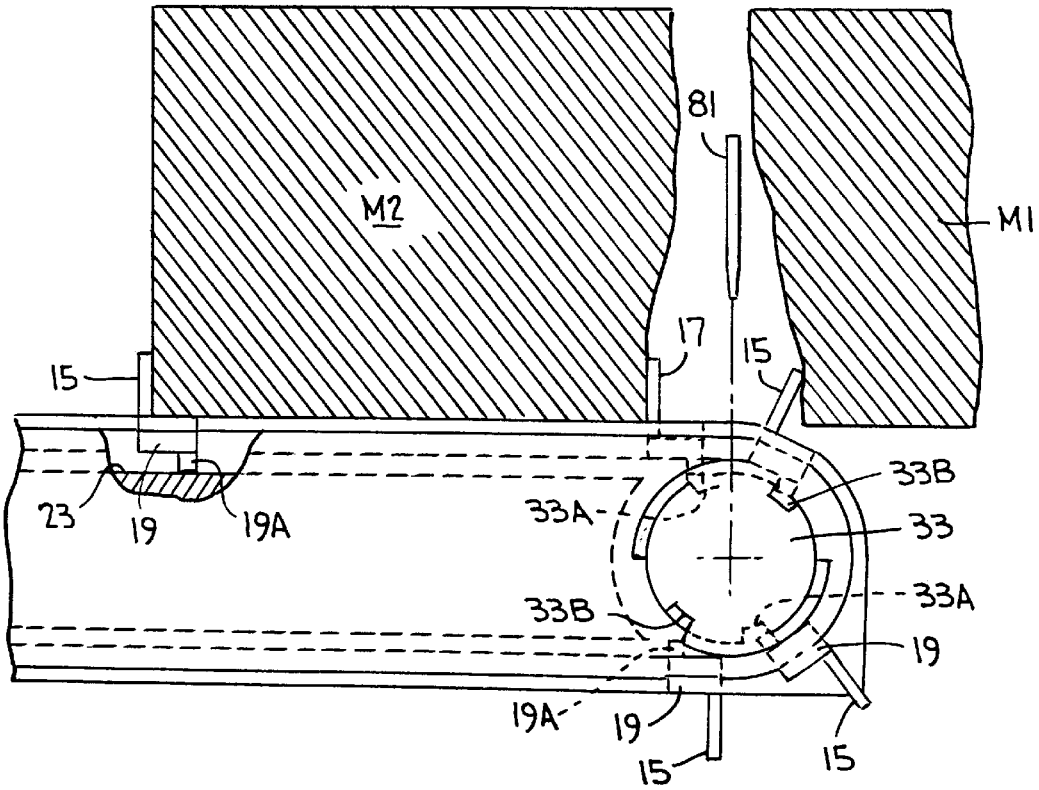

When the two pairs of sliders located one above the other 19, 21 on the two sides of the channel for the advance of the stack P, P1, P2 reach the end of the rectilinear section of the guides 23, 25, a rotation of the toothed sprockets 33 by one step causes the angular movement of the upper separating fingers 15 (with the corresponding sliders 19) away from the lower separating fingers 17 (with the corresponding sliders 21). This operation is represented in FIGS. 7 and 8. This moves the more advanced pack of napkins M1 away from the following pack M2, to facilitate the discharge of the pack M1 by the discharge means which will be described in the following text. Each lower slider 19 is retained in its angular position shown in FIG. 8 by the striking of the appendage 19A against the circumferential edge of the sprocket 33, until the slot 33B engages the corresponding appendage 19A, rotating the slider 19 and the corresponding finger 17 in the clockwise direction.

Figure 9:
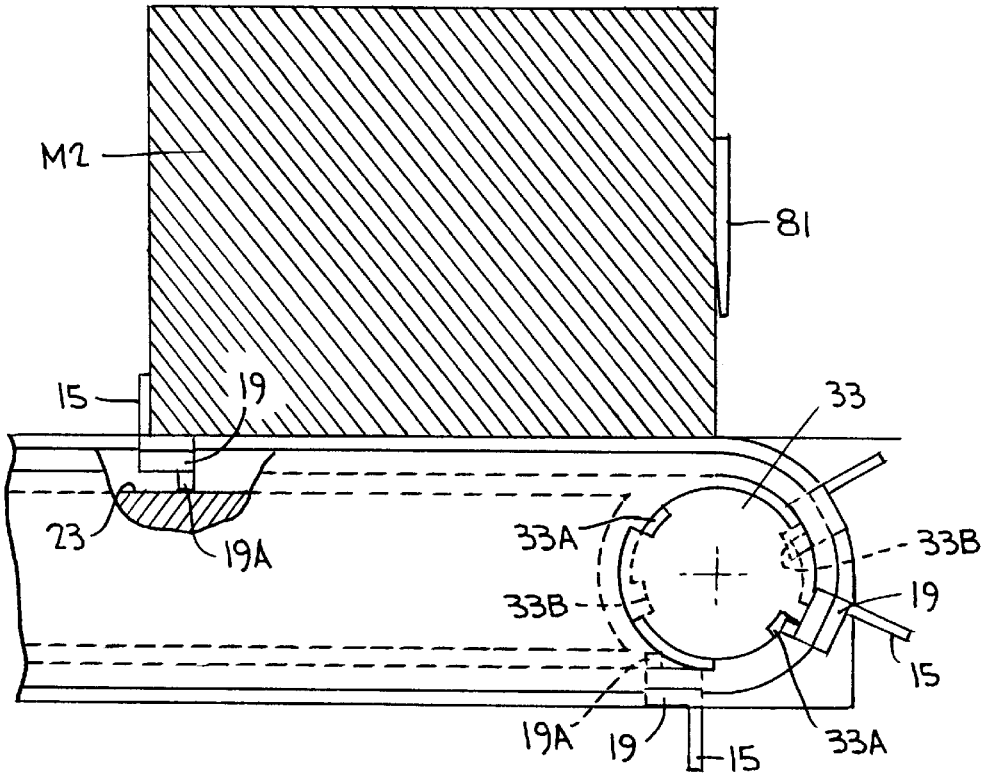

This successive rotation (FIG. 9) of each of the two toothed sprockets 33 causes the lower separating fingers 17 to be disengaged from the stack of articles, which is retained temporarily by a blade 81, described in greater detail in the following text. By successive rotations by one step of the slotted sprockets 33, the sliders 19, 21 are brought above the corresponding continuous flexible members 35 so that they are returned towards the slotted discs 31 and start a new cycle.

Figure 10:
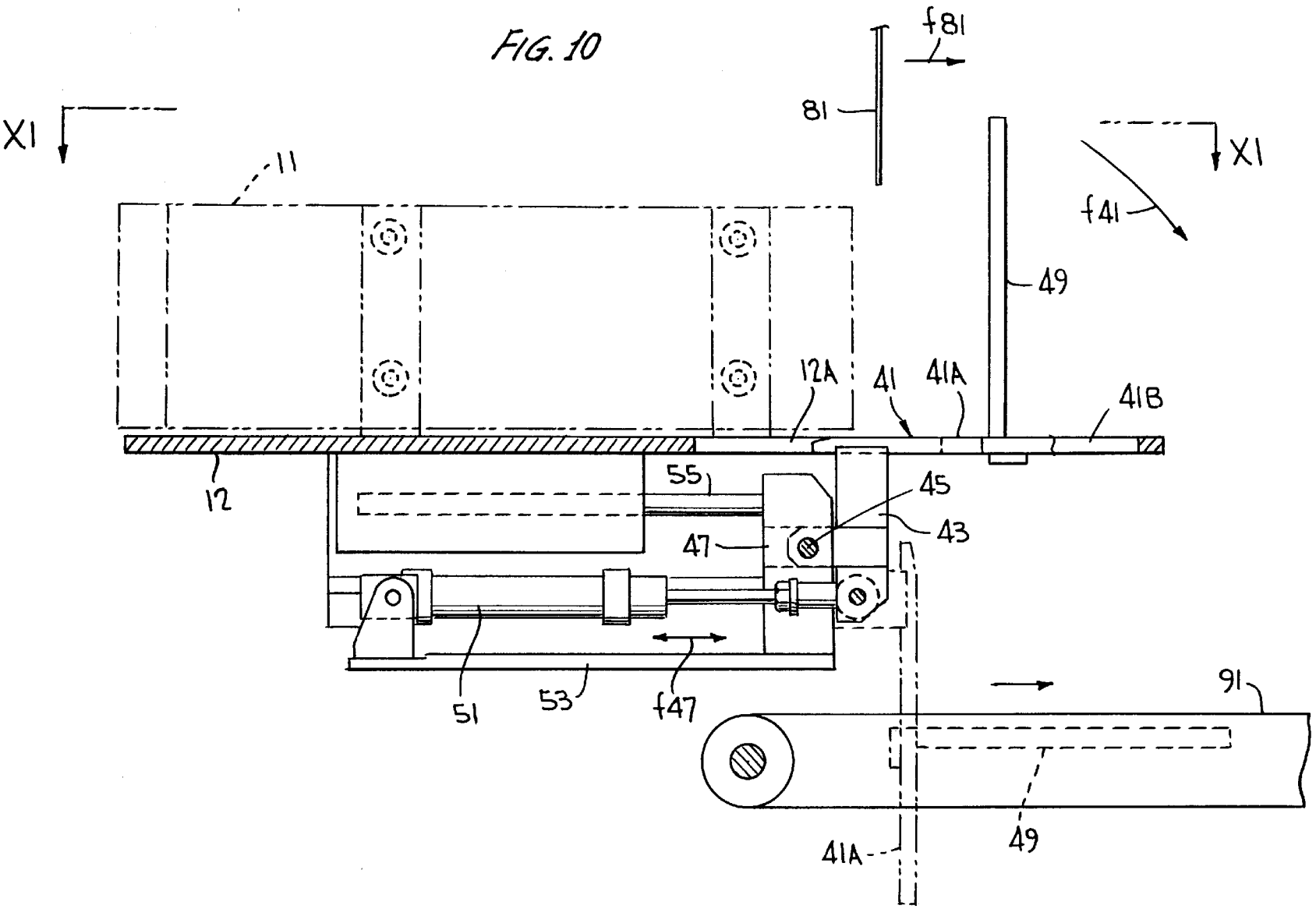
FIG. 10 shows a longitudinal section, through the line X—X in FIG. 11, of the means of discharge of the articles.
Figure 11:
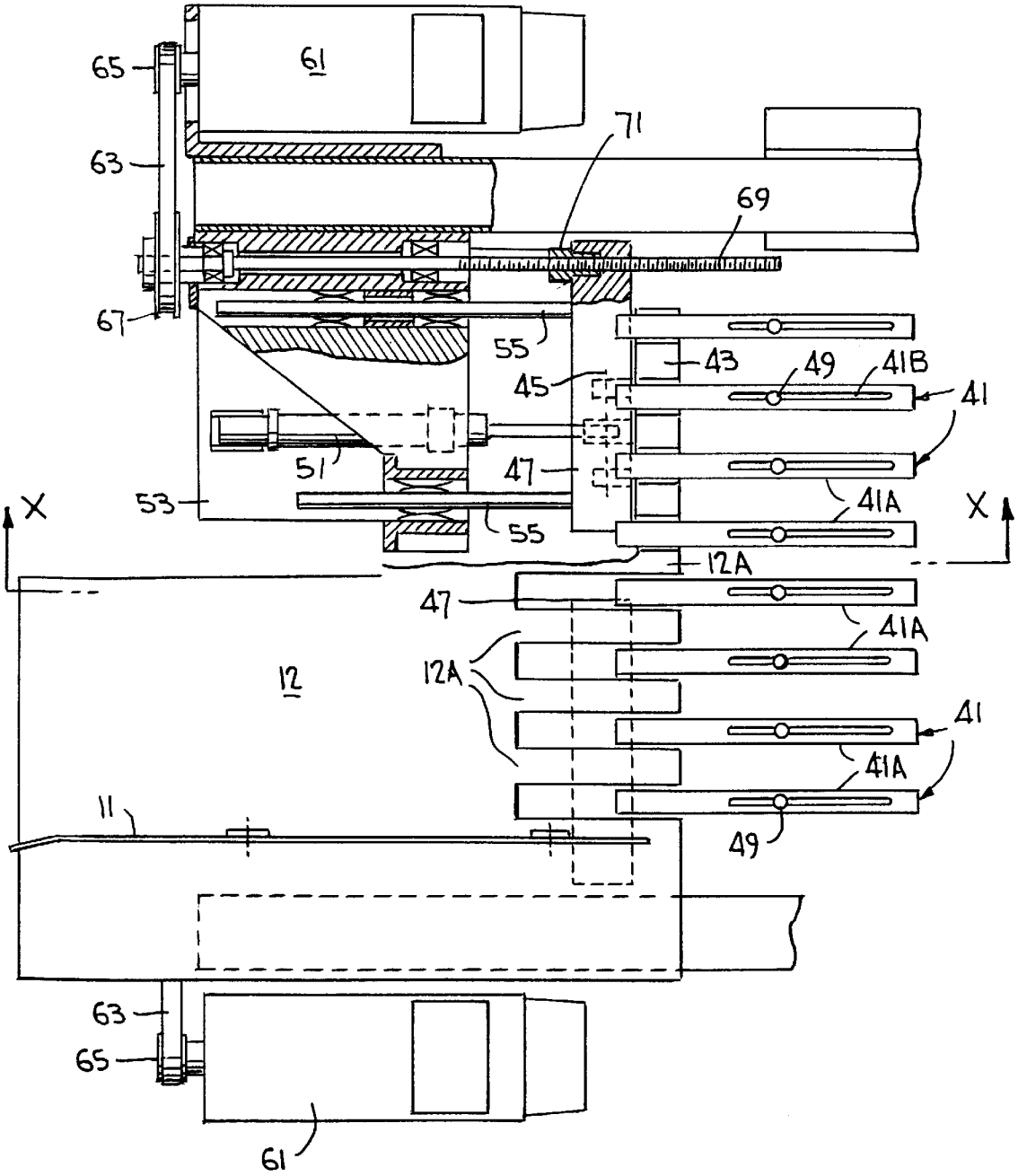
FIG. 11 shows a plan and partial sectional view approximately through XI—XI in FIG. 10.

The means of discharge of the individual packs M1, M2 . . . Mn of articles are illustrated in detail in FIGS. 10 to 12.

The wall 12 forming the base of the channel for the advance of the stack P, P1, P2 ends in a comb-shaped portion 12A which interacts with a movable surface 41 formed by a plurality of strips 41A carried by a bracket 43 hinged at 45 to a block 47. Each strip 41A has a slot 41B in which a bar 49 orthogonal to the surface 41 is engaged in an adjustable position. The bars 49 are aligned with each other to form a vertical surface to stop and contain the stack of articles.

The surface 41 formed by the strips 41A can be tipped about the axis 45 by means of a cylinder and piston actuator 51 carried by a plate 53 which is integral with the block 47. The block 47 with the plate 53, the actuator 51 and the surface 41 also move in the direction of the double arrow f47. The movement is permitted by the fact that the strips 41A forming the surface 41 penetrate into the voids formed in the comb portion 12A of the surface 12 for the sliding of the stack P of articles. This movement is controlled by a "brushless" electric motor or similar 61, which transmits the motion through a toothed belt 63 and a pair of pulleys 65, 67 to a threaded rod 69 engaged with a ball screw nut 71 carried by the block 47. The disposition is symmetrical on the two sides of the channel for the advance of the stack of articles. The motor 61 may advantageously be controlled by a PLC which controls its movement as a function of the thickness of the strip material N and of the rate at which this material is fed and folded, for the purposes which will be made clear in the following text.

Figure 12:
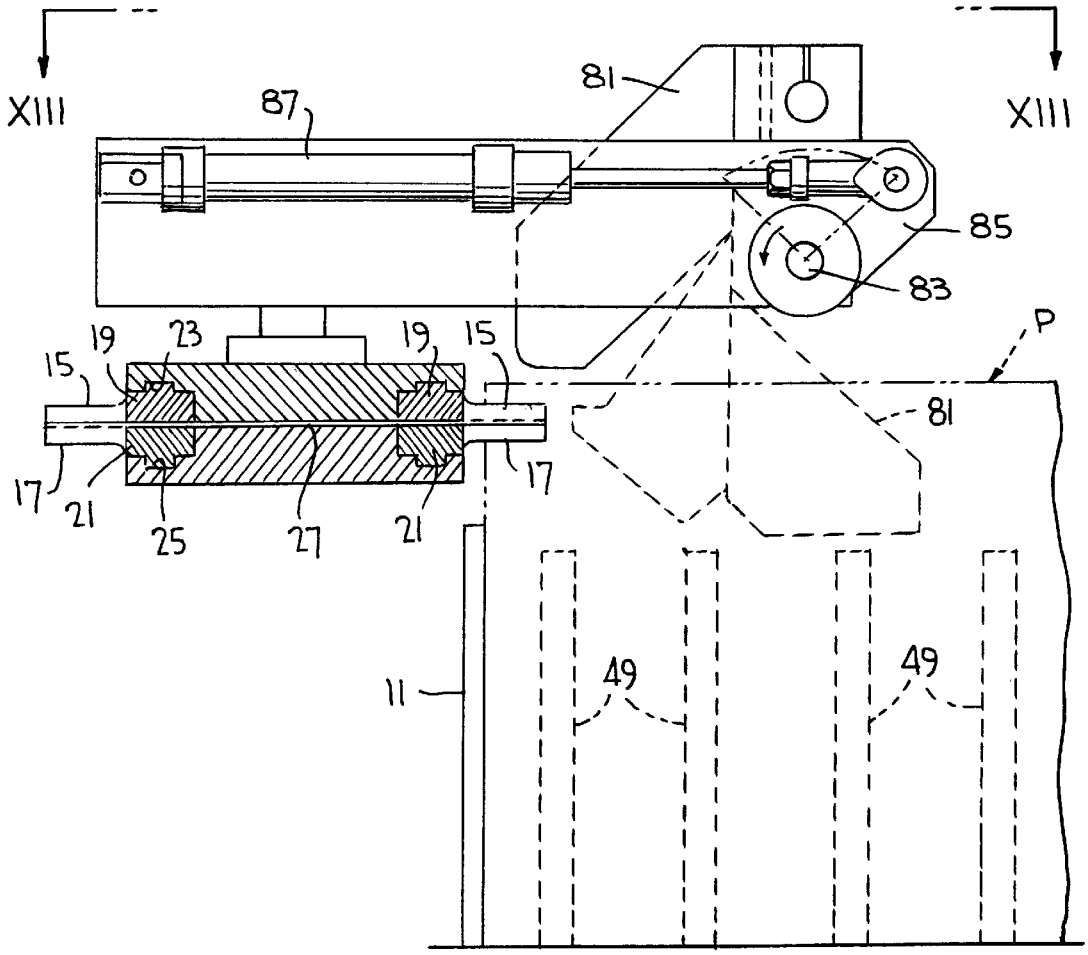
FIG. 12 shows a local front view, through XII—XII in FIG. 13, of the retaining blade for the stack of articles.
Figure 13:
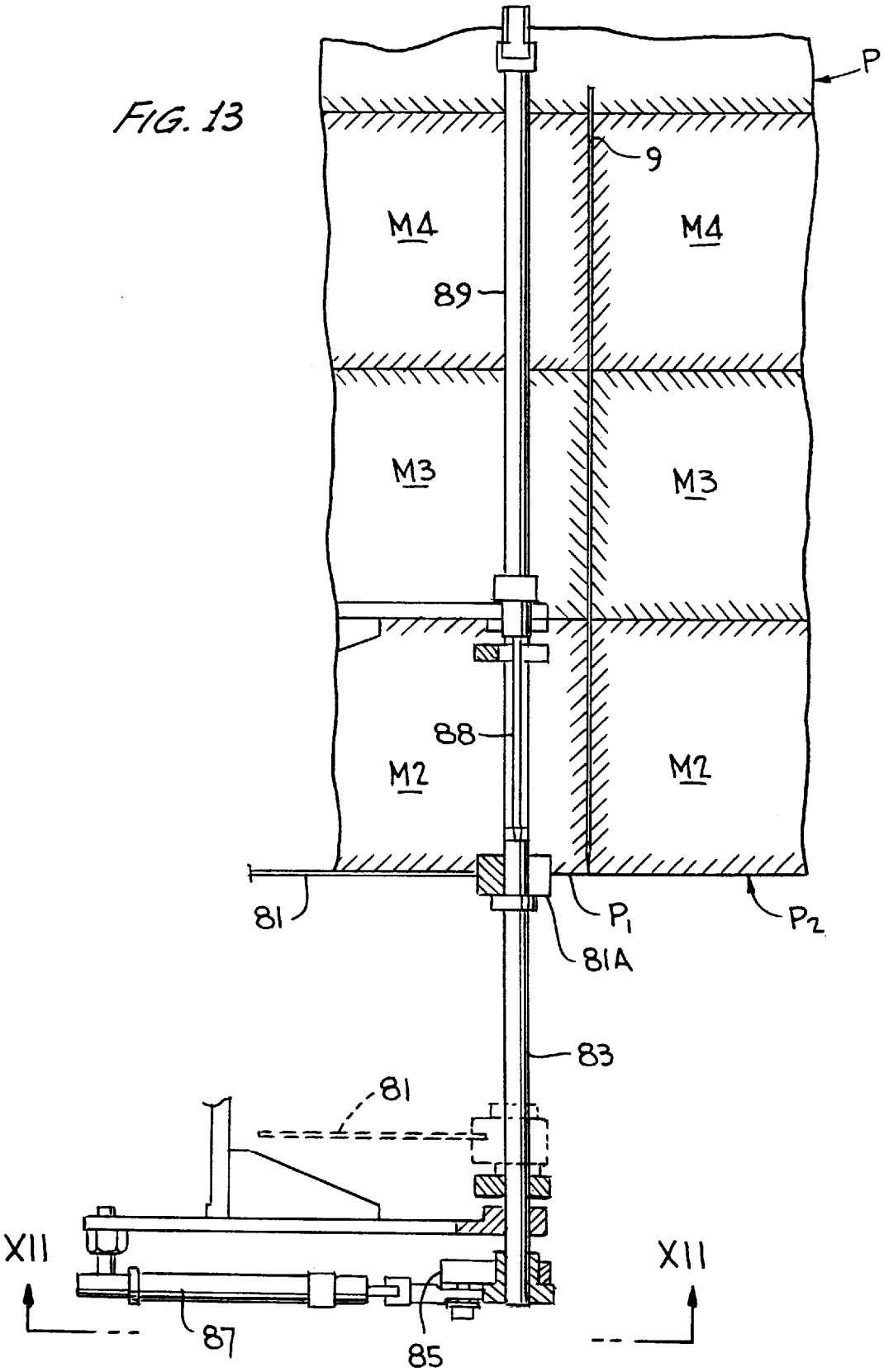
FIG. 13 shows a view, with parts removed, through XIII—XIII in FIG. 12.

The blade 81, driven by a mechanism illustrated separately in detail in FIGS. 12 and 13, is disposed above the surface 41. The blade 81 is fixed to a shaft 83 which extends parallel to the direction of advance of the stack P, P1, P2 of articles, in such a way that it oscillates integrally with the shaft about the axis of the shaft. The shaft 83 is fixed by an arm 85 to a cylinder and piston system 87 which causes it to oscillate about its axis to cause the oscillation of the blade 81 between an upper position in which it is withdrawn from the stack P, P1, P2 (shown in solid lines in FIG. 12) and a lower position (shown in broken lines in FIG. 12) in which the stack of articles rests on the blade.

The support 81A of the blade (FIG. 13) is also fixed to the rod 88 of a further cylinder and piston actuator 89 which moves the blade 81 in a direction parallel to the direction of advance of the stack P.

The disposition described here is symmetrical, a pair of blades 81 being provided side by side, one for each portion P1, P2 of the stack of articles issuing from the machine.

The operations of discharging the packs of articles take place in the following way.

The bars 49 are initially brought into their position closest to the folding rollers 1 and 3, and the leading articles in the stack P, P1, P2 rest on the bars 49 and are pushed against them. As the strip material N is folded and the napkins are formed by the rollers 1, 3 and by the blade 9, the bars move under the control of the motor 61 to provide space for new articles issuing from the machine.

A sensor (not shown) sends a signal when a pair of fingers 15, 17 reaches the position shown in FIG. 1. This signal represents the permission for the start of the discharge cycle for the pack M1 of napkins, which takes place as follows: the fingers 15, 17 on each side of the advance channel are moved apart into the position shown in FIG. 8; the blade 81 is lowered and penetrates into the void created by the movement apart of the fingers 15, 17; the surface 41 is rotated through 90° by means of the cylinder and piston actuator 51 to tip the pack M1 onto a conveyor 91 consisting of a plurality of parallel belts between which the strips 41A and the corresponding bars 49 pass. In this phase, the finger 15 accompanies the tipping movement of the pack of napkins through a first part of said tipping movement, retaining the pack from the rear. The following pack M2 is retained frontally by the corresponding finger 17 and by the blade 81. When the pack M1 has been deposited on the conveyor 91 and removed from the discharge area by the conveyor, the surface 41 is raised again by means of the cylinder and piston actuator 51, while the brushless motor 61 causes the system 41, 43, 47, 49 to move back to a position in which the bars 49 come into contact with the front surface of the pack M2. This position is determined by the PLC controlling the brushless motor 61 according to the values of the thickness of the strip material N and the rate of production, since in the meantime the blade 81 has advanced under the pushing action of the stack of articles to permit the continuous operation of the folder without a substantial increase in the compression of the articles. Before the surface 41 and the bars 49 return to their position of support for the advancing stack, the fingers 17 are made to withdraw by the sprockets 33 (FIG. 9), so that the pack M2 is retained in the last phase by the blade 81 only, which is free to advance under the pushing action of the stack P, extending the rod of the cylinder and piston system 89. When the bars 49 are again in contact with the first napkin of the advancing stack, the blade 81 is withdrawn upwards by means of the actuator 87 and then returned to the initial position by means of the actuator 89.

As may be seen in the attached figures, the actuators and the devices which permit the discharge of the packs of articles are double and symmetrical, since the discharge of the packs M1 from the two portions P1 and P2 into which the stack P has been cut may not take place simultaneously.

It is to be understood that the drawing shows only an example provided solely as a practical demonstration of the invention, and that this invention may be varied in its forms and dispositions without departure from the scope of the guiding concept of the invention. Any presence of reference numbers in the attached claims has the purpose of facilitating the reading of the claims with reference to the description and to the drawing, and does not limit the scope of protection represented by the claims.

What is claimed is:

1. Device for separating from each other packs or groups of flat articles, comprising:

a channel for advancing the articles;

associated with the channel, a plurality of separating fingers which are movable along a closed path comprising a forward portion and a return portion, the forward portion being parallel to the channel and in which the separating fingers advance parallel to and simultaneously with the articles;

at least one pair of guides forming the closed path, wherein a first guide of each of said at least one pair of guides is arranged beside a second guide or the first guide is arranged above the second guide and each guide has substantially equal extensions;

a plurality of pairs of sliders disposed along said guides, a first slider of each said pair of sliders being disposed in a first guide of said at least one pair of guides, a second slider of each said pair of sliders being disposed in a second guide of said at least one pair of guides and each slider carrying at least one corresponding separating finger of said plurality of separating fingers wherein each finger of each said pair of sliders is introduced between two adjacent packs of articles and moves along the closed path with the articles;

a phase displacement means disposed at the end of the forward portion, which temporarily moves said first slider of each said pair of sliders away from the second slider of each said pair of sliders to move one pack of articles away from a following pack.

2. Device according to claim 1, wherein at least two pairs of said guides are present and are positioned along two sides of the channel, each pair of said two pairs of guides having one guide arranged above another guide.

3. Device according to claim 1, wherein said phase displacement means comprises a slotted sprocket rotating about its own axis and provided with two sets of first engagement means disposed at different heights along an axial extension of said sprocket and which are angularly displaced from each other, said first engagement means interacting with a second engagement means which is associated with said sliders.

4. Device according to claim 2, wherein said phase displacement means comprises a slotted sprocket rotating about its own axis and provided with two sets of first engagement means disposed at different heights along an axial extension of said sprocket and which are angularly displaced from each other, said first engagement means interacting with a second engagement means which is associated with said sliders.

5. Device according to claim 3, wherein said first engagement means comprises slots angularly and axially displaced from each other and said second engagement means comprises appendages fixed to corresponding sliders and disposed at different levels so that the sliders are engaged by said slots displaced from each other.

6. Device according to claim 4, wherein said first engagement means comprises slots angularly and axially displaced from each other and said second engagement means comprises appendages fixed to corresponding sliders and disposed at different levels so that the sliders are engaged by said slots displaced from each other.

7. Device according to claim 5, wherein said slotted sprocket is made in two discoid parts coupled together, a first discoid part being provided with a first set of slots and a second discoid part being provided with a second set of slots, said two discoid parts being adjusted angularly with respect to each other.

8. Device according to claim 6, wherein said slotted sprocket is made in two discoid parts coupled together, a first discoid part being provided with a first set of slots and a second discoid part being provided with a second set of slots, said two discoid parts being adjusted angularly with respect to each other.

9. Device according to claim 1 or 2, wherein the sliders are freely slidable in said guides along said forward portion of said closed path, and are propelled by the articles between which the sliders are inserted.

10. Device according to claim 1 or 2, further comprising a return means associated with said return portion of said closed path, constructed and arranged to return the sliders to the start of the forward portion of said closed path.

11. Device according to claim 1 or 2, further comprising a return means to return the sliders to a start of the forward portion of said closed path, the return means comprising a continuous flexible member provided with elements for engagement with the separating fingers or with the sliders.

12. Device according to claim 1 or 2, further comprising a continuous flexible member with bristles interacting with the separating fingers associated with one of said guides.

13. Device according to claim 1 or 2, wherein the sliders of each pair of sliders are constructed and arranged such that the first slider of each pair can be brought into a position ahead of the second slider along said closed path with respect to the direction of advancing of the sliders, but the converse is not possible.

14. Device according to claim 1 or 2 wherein each slider of each pair of said sliders has a stepped edge for reciprocal engagement.

15. Device according to claim 1 or 2, further comprising an insertion member which takes individual pairs of sliders from the return portion of the closed path and inserts the sliders into the forward portion, between one pack of formed articles and a following pack.

16. Device according to claim 15 wherein said insertion member includes a slotted disc rotating step by step about its own axis and provided with engagement elements which interact with engagement means associated with the sliders which are disposed in two guides which are positioned one above another.

17. Device according to claim 16, wherein said engagement elements comprise longitudinal slots in which appendages of said sliders are engaged.

18. Device according to claim 1 or 2, wherein each guide of said pair of guides are separated from each other by a dividing wall made of material having a low coefficient of friction.

19. Device according to claim 1 or 2, further comprising a tipping surface, at the end of said channel, associated with a conveyor for removing packs of articles.

20. Device according to claim 19, wherein said tipping surface includes a stop for the articles, said tipping surface and said stop being movable parallel to the direction of advancing of the articles.

21. Device according to claim 20, wherein movement of said tipping surface and of said stop is controlled by an actuator.

22. Device according to claim 21, wherein the actuator is controlled as a function of speed of advancement of the articles and of thickness of the material forming the packs of articles.

23. Device according to claim 19, further comprising a blade for retaining the articles, and which can retain the articles issuing from the channel during tipping movement of the tipping surface, the blade being insertable in and extractable from the path of advancement of the articles along said channel.

24. Device according to claim 23, wherein said blade has an advancing movement parallel to the direction of advancement of the articles along said channel.

25. Folding machine for producing napkins comprising:

two folding rollers between which a strip of material is fed to form a stack of material folded in a zigzag configuration;

a blade which cuts said stack into two parts of articles;

a device for separating from each other individual packs of articles or groups of articles, comprising:

a channel for advancing of the articles;

associated with the channel, a plurality of separating fingers which are movable along a closed path comprising a forward portion and a return portion, the forward portion being parallel to the channel and in which the separating fingers advance parallel to and simultaneously with the articles;

at least one pair of guides forming the closed path, wherein a first guide of each of said at least one pair of guides is arranged beside a second guide or the first guide is arranged above the second guide and each guide has substantially equal extensions;

a plurality of pairs of sliders disposed along said guides, a first slider of each said pair of sliders being disposed in a first guide of said at least one pair of guides, a second slider of each said pair of sliders being disposed in a second guide of said at least one pair of guides and each slider carrying at least one corresponding separating finger of said plurality of separating fingers wherein each finger of each said pair of sliders is introduced between two adjacent packs of articles and moves along the closed path with the articles;

a phase displacement means disposed at the end of the forward portion, which temporarily moves said first slider of each said pair of sliders away from the second slider of each said pair of sliders to move one pack of articles away from a following pack.

26. Machine according to claim 25, wherein at least two pairs of said guides are present and are positioned along two sides of the channel, each pair of said two pairs of guides having one guide arranged above another guide.

27. A method for separating one pack or group of flat articles disposed in a stack from another, comprising:

arranging at least one pair of guides forming an advancing path, each guide of each said at least one pair of guides having an extension;

advancing packs of flat articles along the advancing path;

arranging a plurality of pairs of separating fingers along the advancing path, a first finger of each said pair of fingers being guided along a first guide of said at least one pair of guides and a second finger of each said pair of fingers being guided along a second guide of said at least one pair of guides;

introducing at least one pair of said plurality of pairs of fingers at an insertion point between a first pack of articles and a second pack of articles;

advancing said at least one pair of said plurality of pairs of fingers along the advancing path toward a discharge area;

at said discharge area, separating said first pack from said second pack by temporarily moving a first finger of said at least one pair of said plurality of pairs of fingers ahead of a second finger of said at least one pair of said plurality of pairs of fingers;

discharging the first pack at the end of the advancing path;

returning the at least one pair of said plurality of pairs of fingers to the insertion point.

28. The method of claim 27, wherein the advancing of said plurality of pairs of separating fingers along said advancing path is caused by the stack of articles being formed.

29. The method of claim 27 or 28, wherein a retaining blade is inserted between the first pack and the second pack to retain the second pack during discharge of the first pack.

30. The method of claim 27 or 28, wherein the packs are discharged by tipping onto a conveyor belt.

31. The method of claim 27, wherein during separation of the first finger and the second finger, one of the first finger or the second finger is temporarily retained in a fixed position to temporarily block advancement of the packs of articles.

* * * * *